United States Patent [19]

Arnal

[11] 4,245,366

[45] Jan. 20, 1981

[54] ROTARY WIRE BRUSHES

[76] Inventor: Claude E. G. Arnal, 91 Rue du Faubourg St., Antoine, Paris 75011, France

[21] Appl. No.: 24,378

[22] Filed: Mar. 27, 1979

[51] Int. Cl.[3] ..... A46B 9/02; A46B 13/02

[52] U.S. Cl. ..... 15/164; 15/56; 15/179

[58] Field of Search ..... 15/56, 101, 106, 164, 15/165, 179

[56] References Cited

U.S. PATENT DOCUMENTS

| | | | |
|---|---|---|---|
| 285,312 | 9/1883 | Shearman | 15/56 X |
| 832,498 | 10/1906 | McHenry | 15/164 |
| 1,564,388 | 12/1925 | Westvig | 15/56 |
| 3,004,274 | 10/1961 | Lee | 15/179 X |

*Primary Examiner*—Christopher K. Moore

*Attorney, Agent, or Firm*—Gottlieb, Rackman & Reisman

[57] ABSTRACT

The invention consists of a wire brush having two sections extending along a common axis, one section having wires extending radially from said axis, and another section adjacent said first section having wires extending radially from an axis perpendicular to the first axis.

14 Claims, 6 Drawing Figures

ROTARY WIRE BRUSHES

One of the objects of the invention is a wire brush consisting of several sections arranged adjacent each other along a common axis, one section when rotating about the axis, brushing against a substantially cylindrical surface, while another section, while rotating about substantially the same axis brushes a substantially flat surface forming the basis of said cylindrical surface.

Another object of the invention is to combine in a single unit several brushes extending along a common axis, one after another, one brush being substantially of a cylindrical configuration, with a substantially circular cross section; another brush being of substantially plane configuration, with a substantially multi-angular cross section.

A specific object of the invention is to combine at least two brushes arranged along a common axis, one next to the other, a cylindrical brush with a circular cross section, and a square brush consisting of two portions facing each other on opposite sides of the common axis, and attached to said axis forming a substantially quadrangular cross section substantially parallel to said circular cross section.

Still another object of the invention is to arrange along a common axis two brushes, one with wires extending radially from said axis, and another brush with wires extending from an axis substantially perpendicular to said common axis, said axis consisting of several portions corresponding to said several brushes arranged therearound; said two axis portions being connected through a flexible coupling permitting said two brushes to operate at an angle with respect to each other.

A further specific object of the invention is to attach two brushes to each other for rotation around a common axis, each of said brushes being impregnated with substantially the same type of elastomer to provide substantially the same amount of brushing pressure; the brushing pressure of one of said brushes being directed against a curved surface; the brushing pressure of the other brush being directed against a flat surface.

These and other objects of the invention will be more apparent from the drawings annexed herein, and in which.

Figure 1:
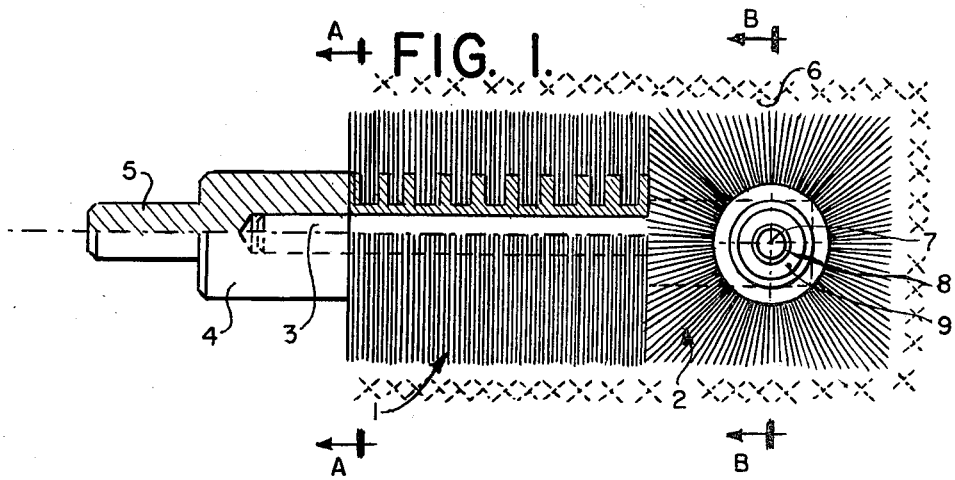
FIG. 1 shows, partly in cross section, an assembly embodying certain features of the invention.

As apparent from FIG. 1, a wire brush consists of two sections, 1 and 2, mounted on a shaft 3 which in turn is pushed under force into a socket 4 provided with a projection 5 to be keyed on the corresponding shaft (not shown) of an electric motor or any other driving mechanism adapted to push the brush with its two sections 1, 2, against a surface to be cleaned as schematically indicated in FIG. 1 by crossdotted points indicating a substantially cylindrical surface 6.

In this way, in accordance with the invention, in one brushing operation, the entire inner space of a cylindrical surface, i.e. not only the cylindrical wall but also the bottom surface terminating the wall can be cleaned in a substantially single operation and by the same brush.

In order to accomplish this continuity of brushing, the wires of brush section 1 are attached extending into a direction radial with respect to shaft 3 while the wires of brush section 2 are attached extending radially to an axis substantially perpendicular to the axis of shaft 1, and as schematically indicated in FIG. 1 at 7, extending through opening 8.

Figure 2:
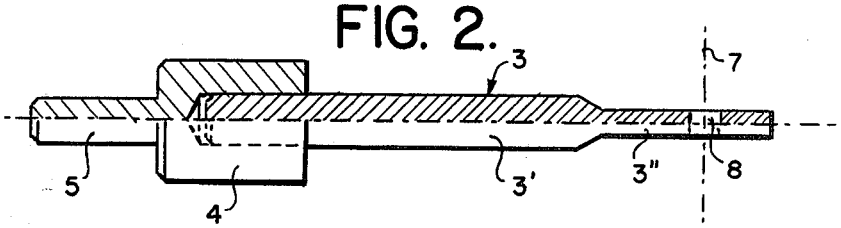
FIGS. 2 and 3 show a driving shaft.
Figure 3:
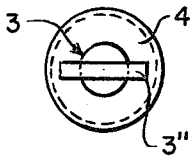

As shown in FIGS. 2 and 3, indicating shaft 3 alone, both brush sections 1,2 are attached for rotation by the same shaft, brush section 1 to shaft section 3', and brush section 2 to shaft section 3'' by means of a rivet 9 schematically indicated in FIG. 1, and connecting the halves of brush section 2 to shaft section 3''.

Through these attachments, and wire extensions, an effective brushing operation not only of the curved and flat surfaces but also of the corner portions of hollow cylinders, and in effect, of any type of rotary-symmetrical shape, may be accomplished.

Figure 4:
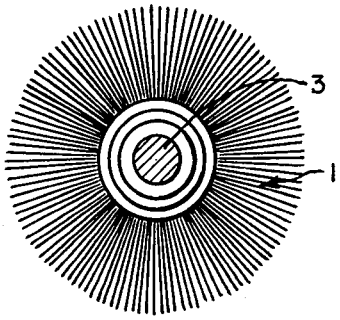
FIG. 4 represents a cross section through one of the brushes of the combination, and FIG. 5 a cross section through another brush forming part of the assembly shown in FIG. 1.
Figure 5:
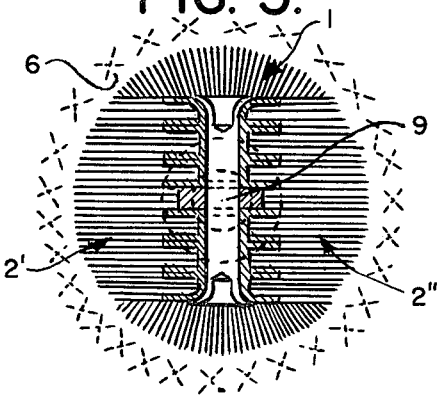

The specific shapes of the different wire sections are more clearly apparent from FIGS. 4, and 5, FIG. 4 representing a cross-section through brush section 1 and FIG. 5 representing a cross section view of brush section 2, in the direction of B—B in FIG. 1. As stated before, brush section 2 consists of two portions connected by rivet 9. In FIG. 5 these two portions indicated at 2' and 2'', respectively, are so cut as be of substantially quadrangular shape. However, the invention is not limited to this sort of shape. Instead of forming a quadrangular cross section, the two half portions of brush section 2 may be cut to have any desired configuration in accordance with the brushing operation to be effectively performed.

Thus for example, this cross-section of brush 2 may be of trapezoidal, triangular or any other desired shape required for the corresponding brushing operation, all this without departing from the scope of this disclosure.

Figure 6:
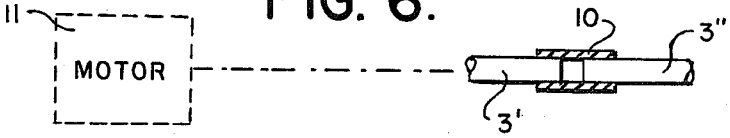
FIG. 6 represents a modification of FIGS. 2 and 3, also illustrating apart from a modification of the driving, shafts, a part of a preferred driving mechanism for the two brushes, which of course could also be applied to the brush assembly shown in FIGS. 1 to 5, all this without departing from the scope of this disclosure.

In the modification of FIG. 6, the two shaft portions 3', 3'' are not rigidly connected, or made of one piece but flexibly coupled or linked to permit the two brushes to operate, if necessary, at an angle, and thereby to provide a better adaptation to the surface to be brushed, this, too, without departing from the scope of this invention.

In one example of this adjustment the two shaft portions are interconnected by means of a rubber sleeve indicated in FIG. 6 at 10, all connected to a driving motor schematically indicated at 11.

However here too, any desired modification of this connection, as well as providing the different brush sections with different cross sections or shapes, further the impregnation of the brush sections with an elastomer, and the impregnation of the different brush sections with different elastomers, may also be applied without departing from this invention.

I claim:

1. In combination, a first brush containing wires extending substantially in a direction perpendicular to a predetermined axis forming a circular cylinder around said axis; and another brush also extending along said axis at least at one end thereof, containing wires extending substantially perpendicular to another axis perpendicular to, and intersecting with said first axis, forming a quadrangular cylinder around said other axis; said quadrangular cylinder having at least one portion of its surface curved to substantially coincide with the curvature of said circular cylinder.

2. Combination according to claim 1, wherein said brushes are attached to a single shaft forming said axis.

3. Combination according to claim 1, wherein said first brush when rotating around said axis, forms a substantially cylindrical space, said other brush extending diametrically across said cylindrical space, having curved end faces substantially coinciding with the curvature of said cylindrical space so as to extend said cylindrical space of said other brush when rotating around said axis.

4. Combination according to claim 1, wherein said other brush consists of two sections and a shaft; the two sections being separated by and attached to said shaft, each of said sections having a cross section which is of substantially quadrangular configuration, having end faces curved to substantially coincide with the curvature of the circular cylinder.

5. Combination according to claim 1, wherein said another brush consists of a pair of brushes separated by and attached to a shaft forming said axis.

6. Combination according to claim 1, wherein said other brush consists of two sections and a shaft; the two sections being separated by and attached to said shaft, each of said sections having a cross section which is of substantially quadrangular configuration, having end faces curved to substantially coincide with the curvature of the circular cylinder.

7. Combination according claim 1, wherein said first brush has a circular cross section surrounding a shaft, and said other brush consists of two sections separated by and attached to said shaft, each of said sections having a cross section of substantially quadrangular configuration, said quadrangular configurations having a length corresponding to the diameter of said circular cross section; the end faces of said configurations being curved to conform to the curvature of said circular cross section, thereby permitting the two brushes to brush a substantially cylindrical wall as well as a bottom thereof perpendicular to said cylindrical wall.

8. Combination according to claim 1, wherein said brushes are arranged along a common axis, and motor means attached to said common axis to permit both said brushes simultaneously to brush a cylindrical wall formed around said common axis, and at least one bottom surface closing said cylindrical wall at least at one end thereof.

9. Combination according to claim 1, comprising as said other brush two brush portions attached at either side of said first brush axis, each of said two portions being of substantially quadrangular configuration crossing the cylindrical space formed around said first brush axis, the end faces of said portions being curved to conform with the curvature of said cylindrical space.

10. Combination according to claim 1, wherein said other brush consists of substantially planar layers extending substantially in planes parallel to said first brush axis; said other brush having end sections, at least one of which is curved, substantially to coincide with at least a portion of the curvature of said cylindrical space, to permit said brushes to simultaneously brush a cylindrical wall formed around said cylindrical space and a flat circular surface adjoining said circular space and forming an end wall of said circular wall.

11. Combination according to claim 1, wherein said first brush contains filaments substantially perpendicular to said axis, forming a substantially cylindrical space, and said other brush contains filaments extending substantially radially from its axis to the periphery of said cylindrical space, but occupying a space close to one end of said first brush, forming a substantially brushing surface consisting of curved peripheral portions of both said brushes as well as a end portion of said other brush, the curved peripheral portions serving to brush cylindrical portions of the article to be operated upon, and said end portion serving to brush a flat surface adjoining said cylindrical surface, substantially without omitting the corner formed between said cylindrical portions and said flat surface.

12. Combination according to claim 1, wherein the wires of said first brush are of substantially equal length extending substantially perpendicular from said axis forming a substantially cylindrical space, and the wires of said other brush are of different Lengths so as to cover a substantially flat circular surface formed at the end of said cylindrical space, said different lengths starting from a minimum near the center of said flat circular surface to a maximum at the periphery of said flat circular surface, said wires of different lengths extending into radial directions from said another axis starting at the center of said flat circular surface and terminating at the periphery of said flat circular surface, forming a curvature of said periphery substantially coinciding with that of said cylindrical space.

13. Combination according to claim 1, wherein the two brushes have shafts coupled to each other to be driven substantially simultaneously.

14. Combination according to claim 1, where the two brushes are flexibly coupled to each other.

* * * * *